US009303294B2

(12) United States Patent
Schluck et al.

(10) Patent No.: US 9,303,294 B2
(45) Date of Patent: Apr. 5, 2016

(54) INSTALLATION FOR THE DRY TRANSFORMATION OF A MATERIAL MICROSTRUCTURE OF SEMI-FINISHED PRODUCTS

(75) Inventors: Peter Schluck, Wolfschlugen (DE); Bernhard Mueller, Stuttgart (DE); Jochen Schwarzer, Ludwigsburg (DE); Johannes Koke, Ludwigsburg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1689 days.

(21) Appl. No.: 12/092,851

(22) PCT Filed: Sep. 26, 2006

(86) PCT No.: PCT/EP2006/066733
§ 371 (c)(1),
(2), (4) Date: Apr. 10, 2009

(87) PCT Pub. No.: WO2007/054398
PCT Pub. Date: May 18, 2007

(65) Prior Publication Data

US 2009/0218738 A1 Sep. 3, 2009

(30) Foreign Application Priority Data

Nov. 8, 2005 (DE) ..... 10 2005 053 134

(51) Int. Cl.
*C21D 1/62* (2006.01)
*C21D 1/613* (2006.01)
(Continued)

(52) U.S. Cl.
CPC *C21D 1/613* (2013.01); *C21D 1/20* (2013.01); *C21D 1/767* (2013.01); *C21D 9/0018* (2013.01); *C21D 2211/002* (2013.01)

(58) Field of Classification Search
CPC ..... C21D 1/62
USPC ..... 266/249, 252
See application file for complete search history.

(56) References Cited

U.S. PATENT DOCUMENTS 5,052,923 A 10/1991 Peter et al.
5,630,322 A 5/1997 Heilmann et al.
(Continued)

FOREIGN PATENT DOCUMENTS

DE 44 22 588 6/1995
DE 44 42 903 6/1996
(Continued)

OTHER PUBLICATIONS

Hofmann et al., "Moeglichkeiten und Grenzen der Gasabkuehlung," HTM Haerterei Technische Mitteilungen, Carl Hanser Verlag, Muenchen, Federal Republic of Germany, vol. 47, No. 2, Mar. 1, 1992, pp. 112 to 122, XP000267300, ISSN: 0341-101X.
(Continued)

*Primary Examiner* — Scott Kastler
(74) *Attorney, Agent, or Firm* — Kenyon & Kenyon LLP

(57) ABSTRACT

An installation for the dry transformation of a material microstructure of semi-finished products, especially for dry bainitization, includes a quenching chamber and a microstructure transformation chamber situated downstream from it in the processing flow, in each case the inner space of the two chambers having applied to it excess gas pressure, at least during the respective method step, for the transformation of the material microstructure. Device(s) are provided for maintaining a minimum excess gas pressure acting on the semi-finished product, during the moving of the semi-finished product from the quenching chamber into the microstructure transformation chamber.

12 Claims, 2 Drawing Sheets

(51) Int. Cl.

| | |
|---|---|
| ***C21D 1/20*** | (2006.01) |
| ***C21D 1/767*** | (2006.01) |
| ***C21D 9/00*** | (2006.01) |

(56) References Cited

U.S. PATENT DOCUMENTS

| | | | | |
|---|---|---|---|---|
| 6,902,635 | B2 * | 6/2005 | Korwin et al. | 266/252 |
| 7,029,625 | B2 * | 4/2006 | Shimosato et al. | 266/252 |
| 2002/0153073 | A1 | 10/2002 | Hattori | |
| 2003/0116894 | A1 | 6/2003 | Korwin et al. | |

FOREIGN PATENT DOCUMENTS

| | | |
|---|---|---|
| DE | 100 44 362 | 4/2002 |
| DE | 101 18 244 | 8/2002 |
| EP | 0 422 353 | 4/1991 |
| EP | 0 962 538 | 12/1999 |
| EP | 1 323 995 | 7/2003 |

OTHER PUBLICATIONS

International Search Report, PCT International Patent Application No. PCT/EP2006/066733, dated Dec. 27, 2006.

* cited by examiner

INSTALLATION FOR THE DRY TRANSFORMATION OF A MATERIAL MICROSTRUCTURE OF SEMI-FINISHED PRODUCTS

FIELD OF THE INVENTION

The present invention relates to an installation for the dry transformation of a material microstructure of semi-finished products.

BACKGROUND INFORMATION

For the improvement of material properties of metallic component parts, it is known that one may influence their material microstructure using heat treatment methods. Steels are particularly suitable for such treatment methods, in addition to a great multitude of metals, and of the steels, for instance, 100Cr6 reacts well to treatment using such austempering methods.

With regard to 100Cr6, heating of the material is first carried out to a temperature of approximately 850° C., for example, so that a so-called austenitic structure is formed in the material. The component parts thus heated must subsequently be rapidly quenched to the austempering temperature. A temperature range of ca. 220° C. is preferred for this, at which the so-called bainitic structure comes about. However, this temperature is only slightly above the so-called martensite start temperature, to which the work pieces absolutely must not cool off during the microstructural transformation process, since this would result in massive interference in the desired, and particularly advantageous, bainitic structure.

To this end, an installation is described in German Published Patent Application No. 100 44 362, in which the components that are to be heat-treated, which are also designated as semi-finished products, are moved in a heated transport car after quenching and regulated catching at transformation temperature, and are transported in the transport car to an annealing furnace.

To do this, the components are taken out of the quenching chamber that is under excess gas pressure [pressure above atmospheric pressure] during the conversion, and are transported, using a transport car, to the transformation chamber that is situated downstream in the process flow, are placed in it and held in it at constant temperature.

When the component parts are moved out of the quenching chamber there is a danger, on the one hand, that, because of a surrounding gas temperature that is too low, the outer areas of the component parts, especially thin-walled sections of the component parts, are cooled too severely. Therefore, it may not be excluded that the gas temperature briefly falls below the martensite start temperature, and thereby at least endangers, if not even prevents, the microstructural development of bainite, for instance, in the component parts. This happens because the edge regions of a component part very rapidly take up the gas temperature, especially in thin-walled places, at corners or at courses of thread.

On the other hand, there is the danger that, during the course of the conversion setting in due to the microstructural transformation in the components, an inadmissible increase in the component temperature occurs, caused by the exothermic processes brought about in this instance, which will also cause massive interference in the transformation of the material microstructure because of microstructural transformation, setting in as a result, into perlite and/or continuous bainite.

SUMMARY

Example embodiments of the present invention provide a method and an installation for the dry transformation of a material structure of semifinished parts.

Accordingly, an installation for the dry transformation of a material microstructure of semi-finished products, especially for dry bainitization, may include a quenching chamber and a microstructure transformation chamber situated downstream from it in the processing flow, in each case the inner space of the two chambers having applied to it excess gas pressure at least during the respective method step for the transformation of the material microstructure. It is provided in this instance, according to example embodiments of the present invention, that device(s) are provided for maintaining a minimum excess gas pressure acting on the semi-finished product, during the moving of the semi-finished product from the quenching chamber into the microstructure transformation chamber.

This procedure is based on the knowledge that, by avoiding a drastic expansion of a gas that is under pressure, it is ensured that, in the surrounding area of the semi-finished product, the gas temperature, and thus also the temperature of the semi-finished products, is not able to drop off to an undesired low point.

Another reason for overpressure in the transformation chamber is the better heat dissipation of the components during the microstructure transformation. The component part temperature is thereby able to be held constant.

In an example embodiment according to the present invention, the device for maintaining a minimum gas pressure on the semi-finished products, during the moving of the semi-finished products, may therefore include a separating wall having a door between the quenching chamber and the microstructure transformation chamber.

To accomplish this, the quenching chamber and the microstructure transformation chamber may be situated such that, bordering on each other, after the end of the quenching process, only the door in the separating wall, between the two chambers that are under pressure, has to be opened in order to move a charge of semi-finished product, that is to be quenched, from the quenching chamber that is under excess gas pressure directly into the microstructure transformation chamber that is also under excess gas pressure. Thus, it is no longer necessary, in this instance, to expand the gas surrounding the semi-finished products until it reaches the environmental pressure. Consequently, the danger of an inadmissible temperature drop goes away which could conceivably put at risk the transformation process. Furthermore, by using this example embodiment of immediately adjacent chambers, such a rapid movement of the semi-finished products is also ensured that the semi-finished products are already in the microstructure transformation chamber before a marked temperature increase is able to take place, based on the exothermic process that is setting in there.

In an example embodiment, it is possible that a single quenching chamber is connected to a plurality of microstructure transformation chambers, corresponding to the first example embodiment. This is of advantage particularly if the retention time of the semi-finished product for the austempering in a microstructure transformation chamber is relatively long.

In an installation thus designed, in each case after a quenching process has taken place, the quenching chamber enclosing them may one by one supply various microstructure transformation chambers assigned to it with appropriate charges of semi-finished product that is to be transformed, in the form of corresponding component parts. This makes possible a process control that is optimized as to time and costs.

In an example embodiment it is, for instance, also possible that the device for maintaining the minimum gas pressure on the semi-finished products, during the moving of the semi-finished products, includes a separately shiftable pressure chamber between the quenching chamber and the microstructure transformation chamber. These could be designed, for example, in the form of a shiftable gate lock that would preferably be equipped with appropriate device, as the microstructure transformation chamber has it too. It may thereby be ensured that, as in the example embodiments proposed above, on the one hand, no pressure reduction of the pressure of the gas surrounding the semi-finished products down to the environmental gas pressure is required, and consequently, no inadmissible cooling of the gas is able to occur. On the other hand, it is also ensured that, if a temperature increase is already setting in, based on the exothermic processes already proceeding in the semi-finished products, the heat created in the process is dissipated in sufficient measure so that no problems are able to arise in the microstructure transformation, based on temperatures that are too high.

In the case of device thus developed for maintaining a minimum excess gas pressure acting on the semi-finished product during the moving process, an installation for austempering may be improved further in its economic efficiency.

With regard to the pressure prevailing in the quenching chamber and in the microstructure transformation chamber, a substantially equal gas pressure is able to prevail in both chambers in an example embodiment. This has the advantage that, when moving takes place between the quenching chamber and the microstructure transformation chamber, no sharp temperature drop is able to take place in the gas, based on gas expansion. Furthermore, the high pressure in the microstructure transformation chamber brings about good heat dissipation from the semi-finished product that is to be heat-treated.

Before removing the greater part, or even all of the semi-finished product transformed in its microstructure from the microstructure transformation chamber, a step-wise or even a slow expansion of the gas under pressure may be provided by appropriately suitable device(s).

In an example embodiment modified compared to this, a pressure ratio may also prevail between the quenching chamber and the microstructure transformation chamber for carrying out the respective process step, which, however, should not be greater than a ratio of approximately 3:1. Using this ratio, it may still be ensured that, because of the relatively slight expansion of the gas occurring in this context, no inadmissible cooling of the gas, and thereby of the component parts that are to be quenched, is able to take place. The usual pressure ranges in the quenching chamber may be approximately in a range from 10 to 30 bar. In order to be able sufficiently to dissipate heat, the level of the pressure in the transformation chamber should not, however, fall below a pressure of 3 bar for any length of time.

In order to be able to temper the microstructure transformation chamber appropriately, the installation preferably also has temperature regulation. With that, the microstructure transformation chamber may be preheated, using appropriate heating elements, before introducing the charge of semi-finished products that are to be tempered, and after introducing the semi-finished products, may be held exactly to the desired temperature using appropriate cooling device(s). These cooling device(s) include particularly a gas stream that flows around the charge and is at a pressure greater than atmospheric pressure. If necessary, a cooling device may additionally be situated in the gas flow, in order to dissipate again the heat given off by the charge and taken up by the gas flow.

For the generation and maintenance of the gas flow, the microstructure transformation chamber may also have a gas recirculating device, for which gas fans or ventilators are particularly suitable.

To move the semi-finished products from the quenching chamber into the microstructure transformation chamber, the installation may furthermore have a transporting device. In the case of a quenching chamber and a microstructure transformation chamber separated only by a separating wall equipped with a door, the microstructure transformation chamber could be operated in clocked fashion. That is, after a quenching operation has taken place, and after opening the door separating the two chambers, the transporting device can be activated, whereupon it moves the semi-finished products from the quenching chamber into the transformation chamber.

For this one might use, for instance, appropriately temperature-suitable conveying means, such as chain conveyors, rotatable rollers situated one behind another, etc. For a star-shaped installation, for example, having a plurality of microstructure transformation chambers, this transporting device might, furthermore, include a turntable, in order to provide an appropriate alignment of the transporting device to the next microstructure transformation chamber to be supplied, or, of course, also to make possible the accommodation of a new charge to be quenched, from a high-temperature furnace situated upstream.

The conveying speed of the transporting device is preferably at least so great, in this context, that the time required for moving the semi-finished products is shorter than the time that passes between the end of the quenching process and a marked increase in temperature of the semi-finished product, based on a microstructure transformation setting in inside of it. As a marked rise in temperature, one would take, in this instance, the range about the point of inflection of a curve reflecting the course over time of the microstructure transformation.

In order to be able to remove the component parts to be heat-treated from the microstructure transformation chamber after the expiration of the process range of a high microstructure transformation rate, the installation may preferably further have a pressure lock. Using such a lock, the component parts in the microstructure transformation chamber may be transferred out and subsequently be reintroduced, if appropriate, into a tempering chamber, situated downstream, having a normal pressure applied to it, such as a forced-air furnace, for completing the remaining microstructure transformation.

Example embodiments of the present invention are explained in more detail on the basis of the drawings and the subsequent associated description.

DETAILED DESCRIPTION

Figure 1:
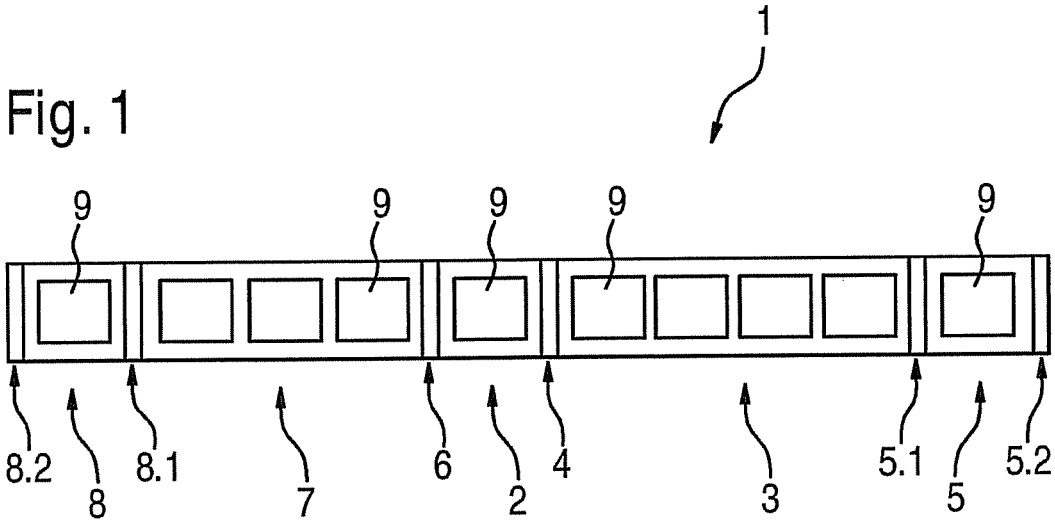
FIG. 1 is a schematic representation of an installation for the dry transformation of a material structure of semi-finished products.

FIG. 1 shows in detail an installation 1 for the dry transformation of a material structure of semi-finished products, particularly for dry bainitization. It includes a quenching chamber 2 and a microstructure transformation chamber 3 that is situated downstream in the processing flow direction, in each case the inner space of the two chambers having applied to it excess gas pressure at least during the respective method step for the transformation of the material microstructure. The semi-finished products to be heat-treated are shown for example, as charges 9.

When the semi-finished products are moved between the quenching chamber and the microstructure transformation chamber, they are not supposed to experience any substantial temperature change. Especially critical, in this connection, are the outer areas or even thin-walled areas which tend quickly to fall below an admissible temperature range. Approximately the range of ±5° C. is regarded as the admissible fluctuation width, compared to the temperature of ca. 220° C. applied to the semi-finished products in the quenching chamber.

According to example embodiments of the present invention, device(s) are provided for maintaining a minimum excess gas pressure acting on the semi-finished product, during the moving of the semi-finished product from the quenching chamber into the microstructure transformation chamber. In this example embodiment, these device(s) include a separating wall 4 having a door between quenching chamber 2 and microstructure transformation chamber 3. Since both chambers have excess gas pressure applied to them simultaneously, a pressure equalization has to take place between the two chambers, before the door is opened. This preferably takes place by a pressure reduction in the quenching chamber. However, in this instance, the semi-finished products of charge 9 continue to have applied to them the same excess gas pressure as that which prevails in the microstructure transformation, so that an inadmissible material cooling is avoided.

Subsequently, charge 9 may be moved from the quenching chamber to the performance of the microstructure transformation process, which lasts very much longer compared to the quenching process (ca. 35 to 40 sec, depending on the material, shape of the component part, and size of the component part of the semi-finished products, and up to several hours.

After the end of the moving process for charge 9, the door in separating wall 4 between the two chambers 2, 3 may be closed again, in order to separate the chambers in a pressure-tight manner. Quenching chamber 2 may then be prepared for accommodating a new charge 9 to be quenched, while in the microstructure transformation chamber the microstructure transformation process sets in, in the moved semi-finished product.

Figure 2:
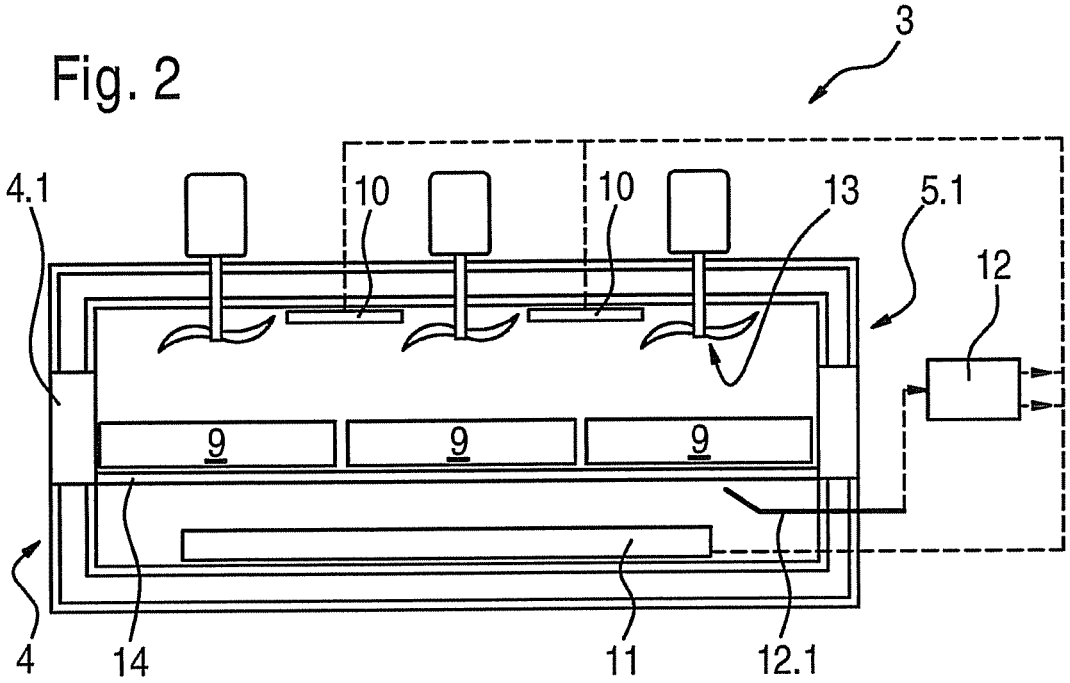
FIG. 2 is a schematically shown arrangement of a material microstructure transformation chamber.

In order to provide the temperature required for the microstructure transformation, microstructure transformation chamber 3, according to FIG. 2, may include a heating device 10 and/or a cooling device 11, which are preferably controlled via a temperature regulation 12, which includes a temperature sensor 12.1. For the uniform temperature distribution inside the microstructure transformation chamber 3, as well as for better heat dissipation, the latter may further include one or more gas circulating devices 13, which here, in the present example embodiment, are designed as blowers or ventilators. In order to be able both to move charge 9 from quenching chamber 2 into microstructure transformation chamber 3 and, if necessary, transport it further in the microstructure transformation chamber, the installation furthermore includes a transporting device 14. This transporting device 14 may advantageously be operated in a clocked manner. By doing that, charges 9 are able to be transported further through the entire installation 1, in appropriately clocked steps. Those parts of the installation, in which the semi-finished products require a greater retention time for the performance of the respective process step, may be provided for it such that they are suitable for accommodating a plurality of charges. These charges then run through the respective installation section, for instance, microstructure transformation chamber 3, according to the clocked transportation.

Additional installation parts may be inferred from FIG. 1. In FIG. 1, a high-temperature furnace 7 is shown, positioned ahead of the quenching chamber in the process sequence. In it, three charges 9 are situated, for example, in order for them to be heated to a temperature from which they will be cooled again in the quenching chamber. The austenitizing temperature is involved here, which in the case of 100Cr6 is approximately 850° C.

The two chambers 2, 7 are separated from each other by a separating wall 6 that is developed in a manner corresponding to separating wall 4. Since high-temperature furnace 7 is preferably operated under vacuum, a lock 8 is connected ahead of it on the input side, having two lock separating walls 8.1 and 8.2.

In this example embodiment, microstructure transformation chamber 3 is also sealed, using a lock 5 and separating walls 5.1 and 5.2 assigned to it, from the prevailing ambient pressure.

In a simpler example embodiment, for instance, in the case of a correspondingly low operating pressure in the microstructure transformation chamber, instead of lock 5, only a separating wall 5.1 may be provided, having a door appropriately situated in it for removing the semi-finished products transformed in it.

Figure 3:
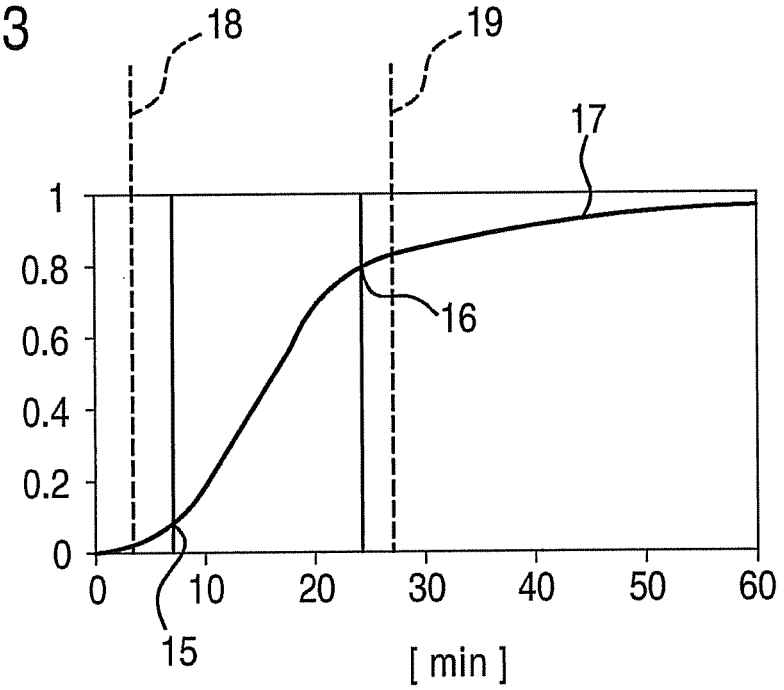
FIG. 3 is a diagram in which the curve of the transformation of a material microstructure is plotted against the horizontal time axis.

The curve of the microstructure transformation in the semi-finished products is shown in exemplary fashion in a diagram in FIG. 3. The time in minutes is plotted horizontally and the proportion of the microstructure transformation in the respective semi-finished products, that has already taken place, is plotted vertically. From this it may be seen that, relatively quickly after the quenching, a strong transformation rate, in this case, for example, sets in in about 8 minutes and lasts for about 15 minutes. This area is bordered by the two points of inflection, 15, 16 of curve 17 that reflects the transformation.

The installation is preferably provided so that the semi-finished products, that are to be transformed, are held at their temperature in a stable manner by the microstructure transformation chamber. As an example, time 18 is given as the beginning, up to which the moving of the semi-finished product from the quenching chamber to the microstructure transformation chamber should be finished. A removal of semi-finished product from the microstructure transformation chamber should first take place only after time 19, at which time approximately 80% of the material microstructure has already been transformed.

Figure 4:
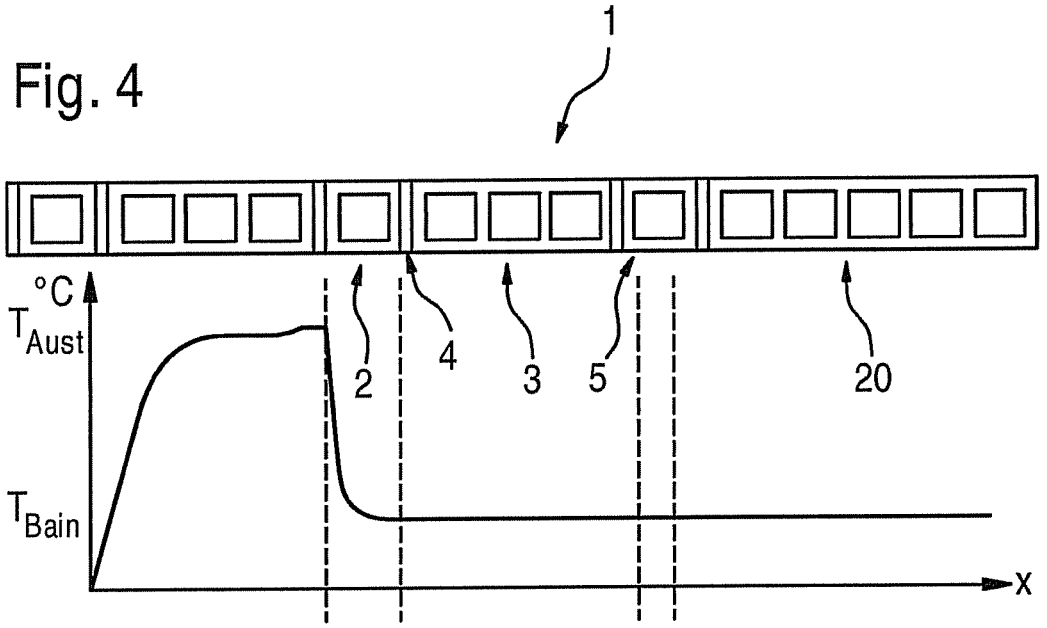
FIG. 4 is an additional schematic representation of an installation for the dry transformation of a material structure of semi-finished products, showing below it the time/temperature diagram associated with the respective process steps.

FIG. 4 shows an additional example embodiment of an installation 1, which has been expanded by a forced-air furnace 20 compared to the specific embodiment in FIG. 1, which is operated at the environmental pressure. The semifinished product remains in the forced-air furnace until such time as the remaining microstructure transformation has also taken place.

Below installation 1 shown in FIG. 4, we show a schematic temperature curve with respect to the installation components lying above it (high temperature furnace, quenching chamber, transformation chamber, lock and forced-air furnace). The temperature in degrees Centigrade is plotted along the horizontal x axis, for the respective modus operandi taking place in the installation, in this context. The highest point of the curve represents the austenitizing temperature $T_{Aust}$, which is approximately 850° C., and at which the semi-finished products are introduced into the quenching chamber. They leave from the quenching chamber at the austempering temperature, in this case the bainitization temperature $T_{Bain}$, which is approximately 220° C. After the complete microstructure transformation, the component parts may be cooled down to the environmental temperature.

What is claimed is:

1. An installation for dry transformation of a material microstructure of semi-finished products, comprising:

a quenching chamber;

a microstructure transformation chamber arranged downstream from the quenching chamber in a processing flow, an inner space of each of the two chambers having applied to it excess gas pressure at least during a respective method step for transformation of the material microstructure; and a device configured to maintain a minimum excess gas pressure acting on the semi-finished product, during movement of the semi-finished product from the quenching chamber into the microstructure transformation chamber, wherein a pressure ratio of not greater than approximately 3:1 prevails between the quenching chamber and the microstructure transformation chamber.

2. The installation according to claim 1, wherein the device configured to maintain the minimum gas pressure includes a separating wall having a door between the quenching chamber and the microstructure transformation chamber.

3. The installation according to claim 1, wherein the device configured to maintain the minimum gas pressure includes a separately shiftable pressure chamber between the quenching chamber and the microstructure transformation chamber.

4. The installation according to claim 1, wherein the microstructure transformation chamber includes at least one of (a) a heating device and (b) a cooling device.

5. The installation according to claim 1, wherein a temperature regulation is provided for the transformation chamber.

6. The installation according to claim 1, wherein the microstructure transformation chamber includes a gas recirculating device.

7. The installation according to claim 1, wherein a transporting device is provided for moving the semi-finished product.

8. The installation according to claim 1, further comprising a pressure lock.

9. The installation according to claim 1, wherein a tempering chamber having normal pressure applied to it is provided downstream from the microstructure transformation chamber in the process flow.

10. The installation according to claim 1, wherein the quenching chamber is adjacent to the microstructure transformation chamber.

11. An installation for dry transformation of a material microstructure of semi-finished products, comprising:

a quenching chamber;

a microstructure transformation chamber arranged downstream from the quenching chamber in a processing flow, an inner space of each of the two chambers having applied to it excess gas pressure at least during a respective method step for transformation of the material microstructure; and a device configured to maintain a minimum excess gas pressure acting on the semi-finished product, during movement of the semi-finished product from the quenching chamber into the microstructure transformation chamber, wherein the device includes a separating wall having a door between the quenching chamber and the microstructure transformation chamber.

12. The installation according to claim 11, wherein the quenching chamber is adjacent to the microstructure transformation chamber.

* * * * *